US009567857B2

(12) United States Patent
Snyder

(10) Patent No.: US 9,567,857 B2
(45) Date of Patent: Feb. 14, 2017

(54) TURBINE SPLIT RING RETENTION AND ANTI-ROTATION METHOD

(71) Applicant: Rolls-Royce North American Technologies, Inc., Indianapolis, IN (US)

(72) Inventor: Brandon R. Snyder, Indianapolis, IN (US)

(73) Assignee: Rolls-Royce North American Technologies, Inc., Indianapolis, IN (US)

( * ) Notice: Subject to any disclaimer, the term of this patent is extended or adjusted under 35 U.S.C. 154(b) by 647 days.

(21) Appl. No.: 14/035,617

(22) Filed: Sep. 24, 2013

(65) Prior Publication Data

US 2014/0301849 A1 Oct. 9, 2014

Related U.S. Application Data

(60) Provisional application No. 61/775,343, filed on Mar. 8, 2013.

(51) Int. Cl.

| | |
|---|---|
| ***F01D 5/30*** | (2006.01) |
| ***F01D 1/02*** | (2006.01) |
| ***F01D 5/02*** | (2006.01) |
| *F01D 11/00* | (2006.01) |

(52) U.S. Cl.

CPC ..... *F01D 1/02* (2013.01); *F01D 5/027* (2013.01); *F01D 5/3015* (2013.01); *F01D 11/001* (2013.01); *F05D 2230/60* (2013.01); *F05D 2240/24* (2013.01); *F05D 2250/182* (2013.01); *F05D 2260/30* (2013.01); *F05D 2260/36* (2013.01); *Y10T 29/4932* (2015.01)

(58) Field of Classification Search

CPC ..... F01D 5/027; F01D 5/3015; F05D 2230/64

See application file for complete search history.

(56) References Cited

U.S. PATENT DOCUMENTS

| | | | | |
|---|---|---|---|---|
| 4,558,988 | A | 12/1985 | Kisling et al. | |
| 4,701,105 | A | 10/1987 | Cantor et al. | |
| 5,582,077 | A | 12/1996 | Agram et al. | |
| 6,106,234 | A * | 8/2000 | Gabbitas | F01D 5/3015 416/220 R |
| 6,682,304 | B2 | 1/2004 | Beeck et al. | |
| 7,040,866 | B2 | 5/2006 | Gagner | |
| 7,238,008 | B2 | 7/2007 | Bobo et al. | |

(Continued)

FOREIGN PATENT DOCUMENTS

| | | |
|---|---|---|
| EP | 0921272 A2 | 6/1999 |

OTHER PUBLICATIONS

International Search Report PCT/US2013/066798 mailed on Jul. 7, 2014.

*Primary Examiner* — Craig Kim
*Assistant Examiner* — Juan G Flores
(74) *Attorney, Agent, or Firm* — Fishman Stewart PLLC

(57) ABSTRACT

A gas turbine engine disk split retainer ring system is provided and includes an apparatus and method for retaining a split ring in relation to a turbine cover plate or disk. Pegs are used to capture and retain a split retainer ring of the gas turbine rotor in relation to the cover plate. An anti-rotation peg has a radially oriented tab for engaging the split ring so as to control the rotation of the ring. The system may be used to balance the operating condition of a turbo machine.

20 Claims, 5 Drawing Sheets

(56) References Cited

U.S. PATENT DOCUMENTS

| | | | | |
|---|---|---|---|---|
| 7,371,050 | B2 * | 5/2008 | Pasquiet | F01D 5/3015 416/204 A |
| 7,458,769 | B2 * | 12/2008 | Forgue | F01D 5/26 415/119 |
| 7,597,499 | B2 | 10/2009 | Udall | |
| 8,122,785 | B2 * | 2/2012 | Czerniak | F01D 5/027 73/470 |
| 8,888,458 | B2 * | 11/2014 | Billings | F01D 5/027 416/144 |
| 2003/0194318 | A1 | 10/2003 | Duesler et al. | |
| 2007/0020089 | A1 | 1/2007 | Forgue et al. | |
| 2010/0215501 | A1 | 8/2010 | Ammann | |
| 2011/0250071 | A1 | 10/2011 | Arilla et al. | |
| 2012/0027598 | A1 | 2/2012 | Caprario | |
| 2012/0275920 | A1 * | 11/2012 | Delvaux | F01D 5/3015 416/204 R |
| 2013/0202433 | A1 * | 8/2013 | Hafner | F01D 5/3015 415/230 |

* cited by examiner

TURBINE SPLIT RING RETENTION AND ANTI-ROTATION METHOD

CROSS-REFERENCE TO RELATED APPLICATIONS

This application claims priority to U.S. Provisional Patent Application No. 61/775,343, filed Mar. 8, 2013, the contents of which are hereby incorporated in their entirety.

GOVERNMENT RIGHTS

This invention was made with government support under FA8650-07-C-2803 awarded by the United States Air Force. The government has certain rights in the invention.

FIELD OF TECHNOLOGY

An improved rotary assembly for a gas turbine engine and more particularly, an improved rotary disk assembly in the turbine section of a gas turbine engine.

BACKGROUND

Retention arrangements are used particularly in relation to engines where there are rotating shafts as it is important to retain the association between seals and other components within the engine. In particular, a rotary gas turbine engine may incorporate a cooling air system in which relatively cool air is conveyed over at least one face of a turbine disk in a radially outward direction before it is introduced through channels or orifices near the periphery of the disk to an internal blade cooling system via blade roots. A cover plate is carried on the disk face to both create a cooling volume for the disk face and a plenum for the airflow into the blade roots. The cover plate is sealed against the disk face to avoid cooling air loss, and normally carries part of a seal assembly co-operating with an adjacent stationary part. The design of the cover plate, therefore, requires stability, dynamic balance, and tolerances to differential thermal expansion between the disk and the cover plate. Further, the cover plate must be positively located on the face of the disk but remain capable of being disassembled and accurately rebuilt.

The assembly of the cover plate to the disk may require a compressible ring that is radially captured at its center diameter by a groove in the disk. During assembly, a special tool is often required to compress the ring to be held in the disk groove to allow a cover plate to pass over the ring. The ring can then be allowed to expand so that a portion of the ring extends above the disk groove and interferes with the cover plate to provide axial retention. The specially configured tool compresses and holds the ring in the disc groove during assembly and disassembly. Such arrangement, however, requires a groove to be machined in a wall of the disk. Such constructs typically do not provide any type arrangement for correcting rotor assembly imbalance, which is not desirable in the airline industry. Moreover, because past methods of assembly and disassembly require special tools to be employed so as to collapse the ring within the disk groove, additional costs are incurred by the airline industry both in tooling costs as well as human capital that is required to maintain and operate such tools. Moreover, the assembly process can be difficult and time consuming due to the nature and size of the tools and components. The tools that are used include small clips that hold the ring into the disk groove. Using the clips is complicated. Due to this difficulty, several attempts may be required before the components are successfully assembled and the opportunity for damage increases with each attempt. Accordingly, it would be preferable to reduce maintenance costs and improve upon the process of assembling and disassembling the aforementioned turbine components.

BRIEF DESCRIPTION OF THE DRAWINGS

While the claims are not limited to a specific illustration, an appreciation of the various aspects is best gained through a discussion of various examples thereof. Referring now to the drawings, exemplary illustrations are shown in detail. Although the drawings represent the illustrations, the drawings are not necessarily to scale and certain features may be exaggerated to better illustrate and explain an innovative aspect of an example. Further, the exemplary illustrations described herein are not intended to be exhaustive or otherwise limiting or restricted to the precise form and configuration shown in the drawings and disclosed in the following detailed description. Exemplary illustrations are described in detail by referring to the drawings as follows:

DETAILED DESCRIPTION

Exemplary illustrations of a gas turbine engine having a turbine disk split retainer ring assembly are described herein and are shown in the attached drawings. An exemplary disk arrangement for a gas turbine engine may include a disk, a cover plate, a split retainer ring, an anti-rotation peg having a first surface for engaging this split retainer ring, and a radial retention peg. Another example may include a system for retaining two separate rotating members in a gas turbine engine including a disk with a plurality of openings, a cover plate having a member that extends within one of the openings of the disk, and an anti-rotation peg with surfaces that may engage the cover plate. At least one radial retention peg engages a surface of the cover plate and a retainer ring may be sandwiched between the cover plate or the radial retention peg.

A method of retaining two separate rotating members of a gas turbine engine may be provided and could include providing a disk, a cover plate, an anti-rotation peg, a radial retention peg, and a retainer ring. The first step may include inserting the cover plate onto the disk using a bayonet tab feature to axially retain the cover plate. Next, an anti-rotation pin can be inserted between the bayonet tabs. Bayonet tabs may be provided on both the cover plate and disk. During assembly the tabs are aligned and the pegs are inserted in the space between. A plurality of radial retention pegs can then be installed, and they may be spaced around the disk and cover plate assembly for adequate radial retention and aiding in rotor balancing. A retaining ring may then be fed between the cover plate and the radial retention pegs until the ring is fully installed. It is possible for the ring to be circumferentially located or clocked, with the anti-rotation peg positioned around the periphery of the assembly, so as to correct for turbine rotor imbalance.

Figure 1:
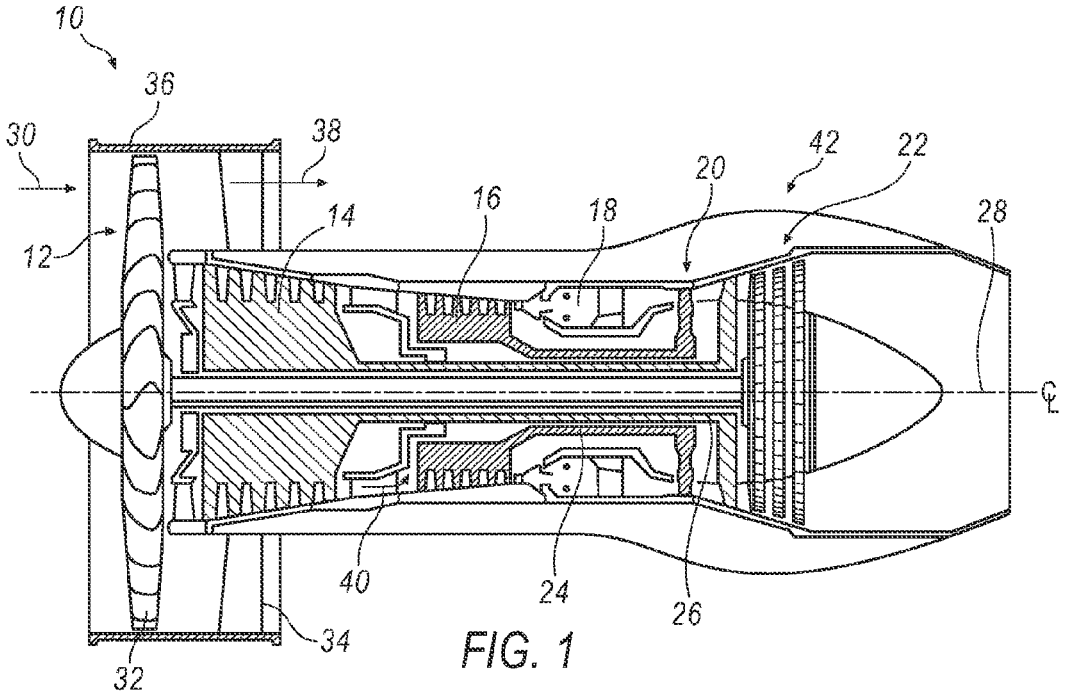
FIG. 1 illustrates a schematic view of a gas turbine engine employing the improvements discussed herein.

FIG. 1 illustrates a gas turbine engine 10, which includes a fan 12, a low pressure compressor and a high pressure compressor, 14 and 16, a combustor 18, and a high pressure turbine and low pressure turbine, 20 and 22, respectively. The high pressure compressor 16 is connected to a first rotor shaft 24 while the low pressure compressor 14 is connected to a second rotor shaft 26. The shafts extend axially and are parallel to a longitudinal center line axis 28.

Ambient air 30 enters the fan 12 and is directed across a fan rotor 32 in an annular duct 34, which in part is circumscribed by fan case 36. The bypass airflow 38 provides engine thrust while the primary gas stream 40 is directed to the combustor 18 and the high pressure turbine 20. The high pressure turbine 20 includes an improved gas turbine rotor assembly 42, which incorporates the improved features disclosed herein. It will be appreciated that the turbine assembly 42 could also be used with the low pressure turbine 22.

Figure 2A:
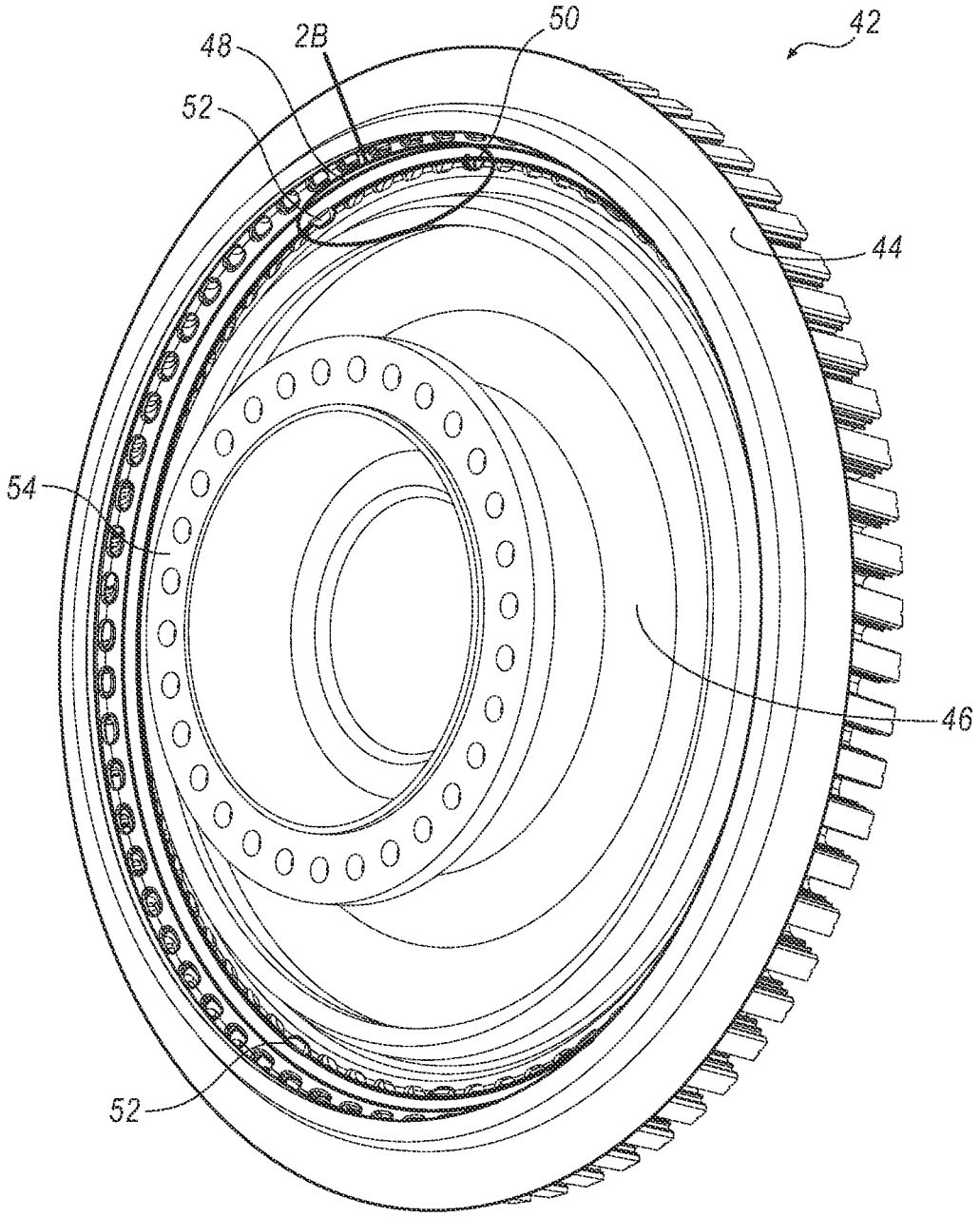
FIG. 2A illustrates a perspective view of a gas turbine rotor assembly.

With reference to FIG. 2A, a gas turbine rotor assembly 42 is provided and includes a cover plate 44, a disk 46, a retainer ring 48, an anti-rotation member 50, sometimes referred to herein as an anti-rotation peg, and at least one radial retention peg 52. The disk 46 has an axially extending hub 54 with a flat face with a plurality of apertures for providing a mounting arrangement for securing the gas turbine rotor 42 to an adjacent turbine component.

Figure 2B:
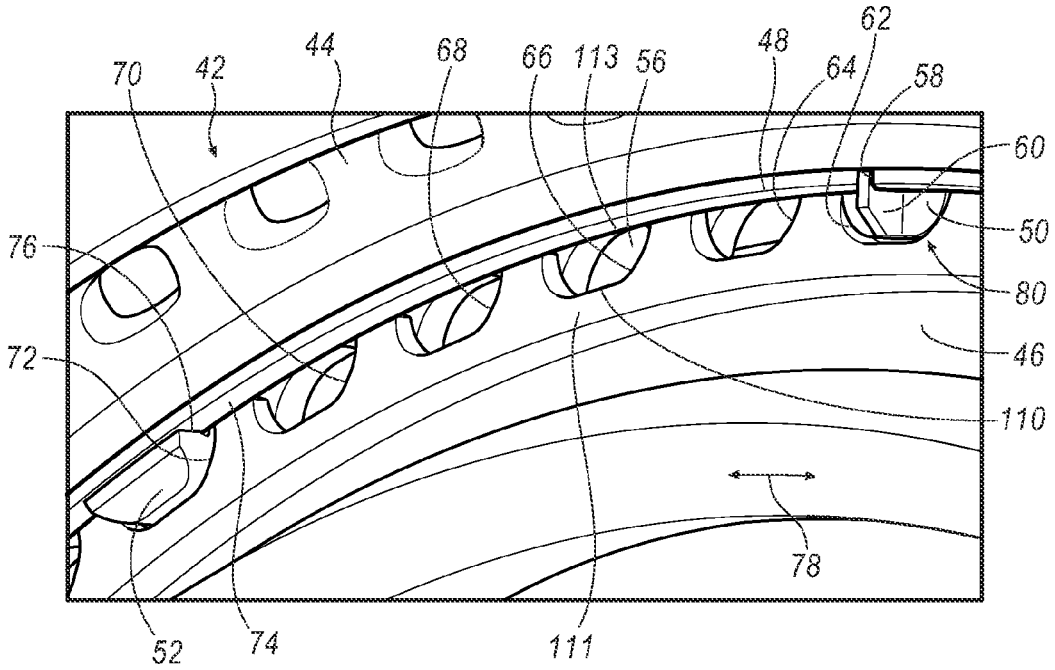
FIG. 2B illustrates an enlarged perspective view, taken from circle 2B of FIG. 2A.

With reference to FIG. 2B, an enlarged perspective view taken from circle 2B of FIG. 2A, is shown illustrating the gas turbine rotor assembly 42 in an exploded configuration. The cover plate 44 is shown circumscribing the disk 46 which is radially offset inward. The disk 46 has a plurality of slots 56 circumferentially spaced around the perimeter of the disk for receiving the anti-rotation peg 50 and the radial retention pegs 52. A split retainer ring 48 is sandwiched between the cover plate 44 and the disk 46, and is held is place in part by the axial and radial interference therebetween. The split retainer ring 48 is annular-shaped and from the front perspective view, a slot 58 is located at an end of the ring 48 so as to allow a tab 60 of the anti-rotation peg 50, to be received within the slot 58. In the side-elevational view, the retainer ring 48 is L-shaped and preferably made of highly durable, and wearable, metal material. See FIG. 7 for the L-shaped cross-sectional configuration of the split retainer ring 40 (FIG. 1).

With continued reference to FIG. 2B, the disk 46 has slots 56 equally spaced around its periphery for receiving various peg members. For example, there is provided a first slot 62, a second slot 64, a third slot 66, a fourth slot 68, a fifth slot 70 and a sixth slot 72. A radial retention peg 52 is shown inserted within slot 72 where an inside diameter 74 of the split retainer ring 48 is shown resting on and impinging upon a radial retention surface 76 of a corresponding radial retention peg 52. The radial retention surface 76 acts to radially restrict the split retainer ring 48 as well as to provide a guide surface for the ring 48 to rotate upon as the ring rotates in a clockwise, or counter clockwise, direction 78. The ring 48 may only rotate while being assembled or disassembled. The first slot 62 is shown having the anti-rotation peg 50 received therein with the tab 60 shown acting as a stop 80, which tends to prevent the retainer ring 48 from rotating.

Figure 3A:
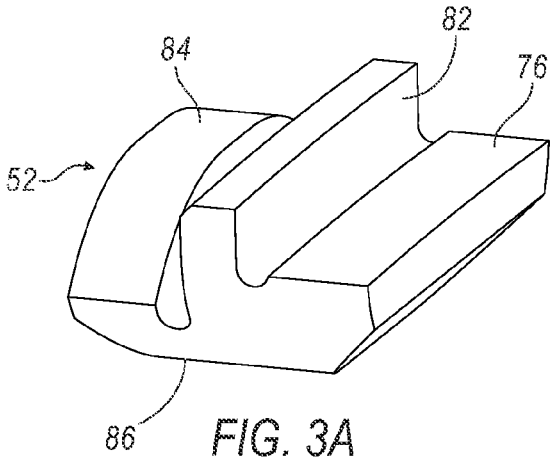
FIG. 3A Illustrates a perspective view of a radial retention peg that is utilized with the gas turbine rotor assembly.

With reference to FIG. 3A, the radial retention peg 52 is preferably made of metal suitable for use in connection with gas turbine conditions. The peg 52 includes a vertically extending surface 82, an arcuate surface 84, a base 86 and the radial retention surface 76. A side-sectional view of the radial retention peg 52 can be seen in FIG. 7.

Figure 3B:
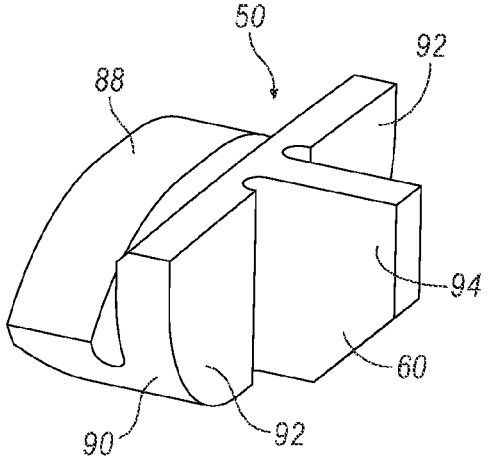
FIG. 3B illustrates a perspective view of an anti-rotation peg that is utilized with the gas turbine rotor assembly.

The anti-rotation peg, or member 50, is shown in FIG. 3B, and includes an arcuate shaped surface 88, a base 90, and a pair of vertical surfaces 92 that are separated by a radially oriented tab 60. The tab 60 extends normal from the vertical surface 92 and provides a flat face 94 in which an end of the split retainer ring 48 may impinge upon. The anti-rotation peg 50 is preferably made of metal that is suitable for use in connection with gas turbine assemblies.

Figure 4:
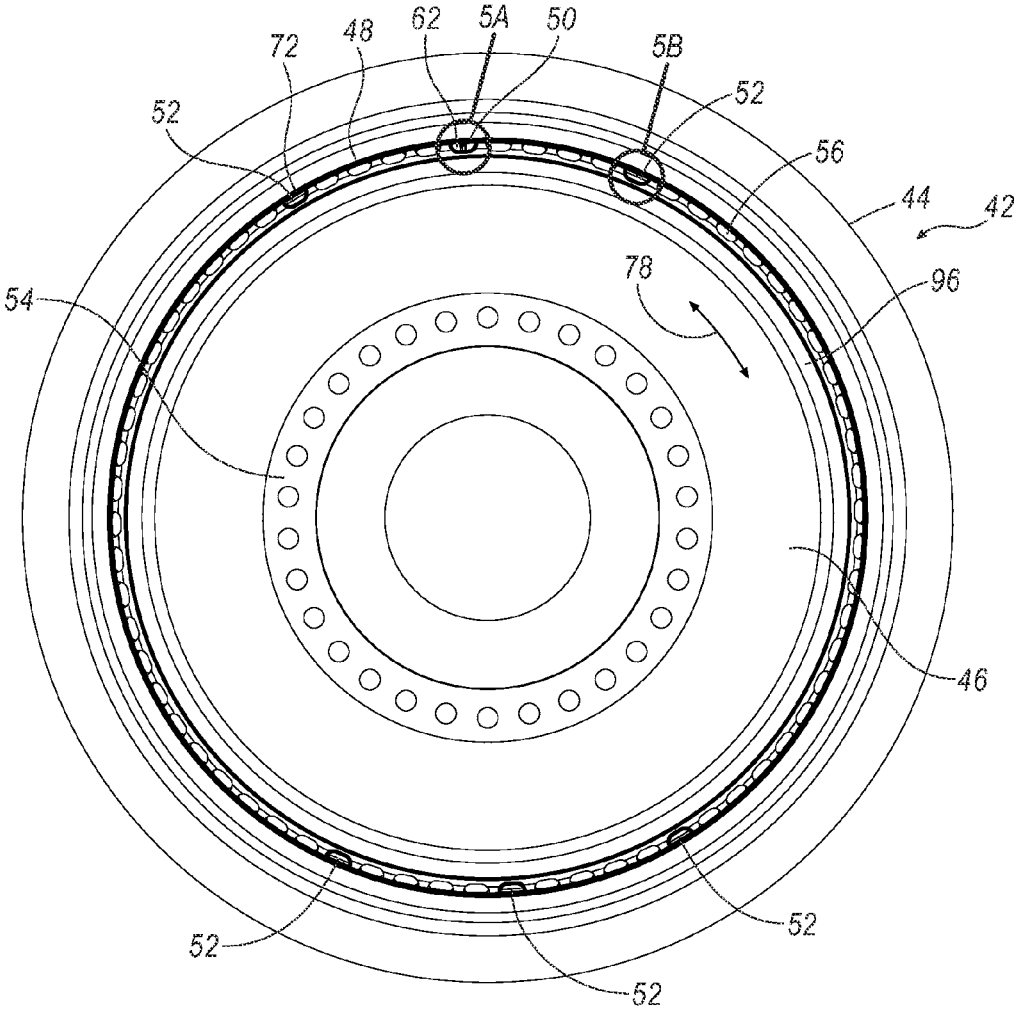
FIG. 4 illustrates a front view of the FIG. 2A gas turbine rotor assembly.

FIG. 4 illustrates a front elevational view of the FIG. 2A gas turbine assembly 42. In this exemplary embodiment, the disk 46 is shown mounted with the cover plate 44. Slots 56 are evenly spaced apart around the periphery 96 of the disk 46 and provide locations for the anti-rotation members 50 and radial retention peg 52 to be positioned therein. In this example, one anti-rotation member 50 is shown located at approximately the zero degree position, while a plurality of radial retention pegs 52 are spaced apart and located at the one o'clock, five o'clock, six o'clock, seven o'clock and at eleven o'clock positions. It will be appreciated that the radial retentions pegs 52 could be located at other positions around the periphery 96 of the gas turbine rotor assembly 42. For example, pegs 52 could be located at the three o'clock, eight o'clock, or other positions, as well. An advantage of the present configuration is that it provides balance correction capability in the event the turbine rotor becomes imbalanced. Further, the disk 46 may be rotated relative to the cover plate 44, by removing the anti-rotation member 50, which in turns frees up the retainer ring 48 so that it can be advanced clockwise, or counter clockwise 78. Thus, the present assembly is operable to be adjusted by locating it circumferentially so as to overcome any rotor imbalance like condition. In the present configuration, five radial retention pegs 52 are employed, along with one anti-rotation peg 50. It will be appreciated, that more, or fewer, radial retention pegs 52, may be employed. The rotating of the ring 48 and the selection of pegs 52 and their location provides technicians with a method of balancing the assembly 42. Thus, the assembly 42 is modifiable, adjustable, balanceable, so as to accommodate the current or preferred operating conditions of the assembly 42.

Figure 5A:
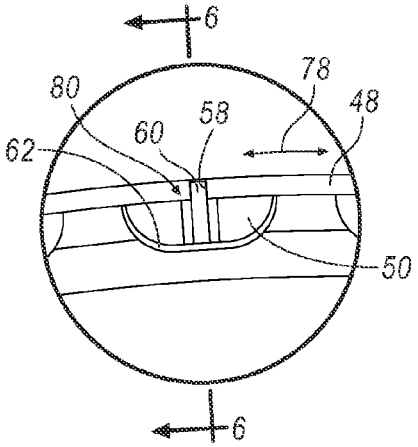
FIG. 5A illustrates an enlarged front view, taken from circle 5A shown in FIG. 4, illustrating the anti-rotation peg installed into the gas turbine rotor assembly.

With reference to FIG. 5A, this illustration depicts an enlarged view taken from circle 5A, of FIG. 4. This configuration represents approximately the twelve o'clock position of the assembly 42 where the anti-rotation peg 50 has been located within slot 62. The split retainer ring 48 includes a slot 58, which provides a clearance for tab 60 to be located. Because the anti-rotation peg 50 is secured in place by the boundaries of the slot 62, the retainer ring 48 likewise is secured in place and is precluded from moving in the direction of arrow 78, thus creating a stop 80 and precluding the ring 48 from rotating.

Figure 5B:
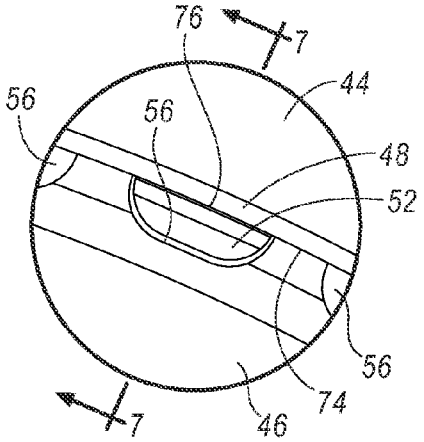
FIG. 5B is an enlarged front view, taken from circle 5B of FIG. 4, showing the radial retention peg installed in the gas turbine assembly.

FIG. 5B illustrates the enlarged view taken from circle 5B of FIG. 4, of the radial retention peg 52 being inserted within a slot 56. The radial retention peg 52 is provided with the radial retention surface 76 that is slightly arcuate-shaped and is operable to receive correspondingly-shaped surface inside diameter 74 of the retainer ring 48. The surface 76 acts as a guide in which the inside diameter of 74 of the ring 48 can impinge upon.

Figure 6:
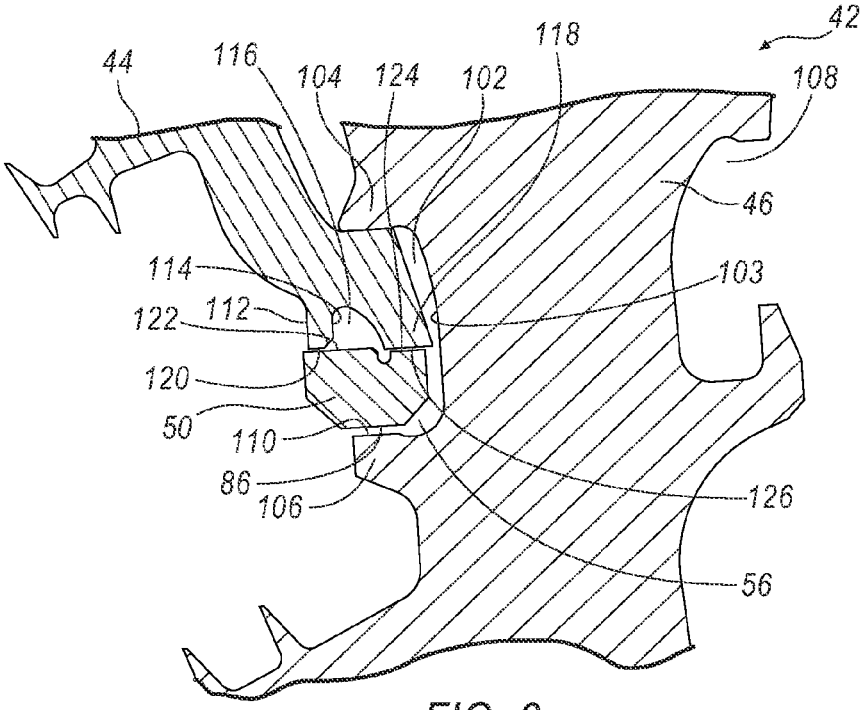
FIG. 6 illustrates an enlarged side-sectional view, taken from the perspective of lines 6-6 of FIG. 5A, showing the anti-rotation peg installed with the cover plate and disk of a gas turbine rotor assembly.

With reference to FIG. 6, this view illustrates an enlarged cross-sectional view taken from lines 6-6 of FIG. 5A. The disk 46 includes a recess 102 that is circumscribed by an outer pilot diameter 104 and an inner diameter 106. The disk 46 may have other openings 108 for receiving other cover plates 44 (which are not shown). A lower surface or scallop 110 of a bayonet feature 111 of the disk 46 (See FIG. 2B) is arcuate shaped and provides a clearance for receiving peg 50. The cover plate 44 has an outer face 112, an inner face 114, an opening 116 and a bayonet feature 118. A first surface 120 of the cover plate 44 engages a radial outer face 122 of the anti-rotation peg 50 which, in part, defines the opening 116 in which the split retainer ring 48 (see FIG. 7) is positioned. The anti-rotation peg 50 has a second radial outer face 124 which engages a surface 126 of the cover plate 44. With this exemplary configuration, the cover plate 44 and the anti-rotation peg 50 are circumscribed by the outer diameter and inner diameter members 104 and 106 so as to provide radial retention relative to the disk 46. The lower surface or scallop 110 creates a partial opening of slot 56 by the disk. The top surface or scallop 113 of the opening of the slot 56 is created by the cover plate 44. The openings are between the bayonet feature 111 of the disk 46 and bayonet feature 118 of the cover plate 44. See FIG. 2B for this relationship.

Figure 7:
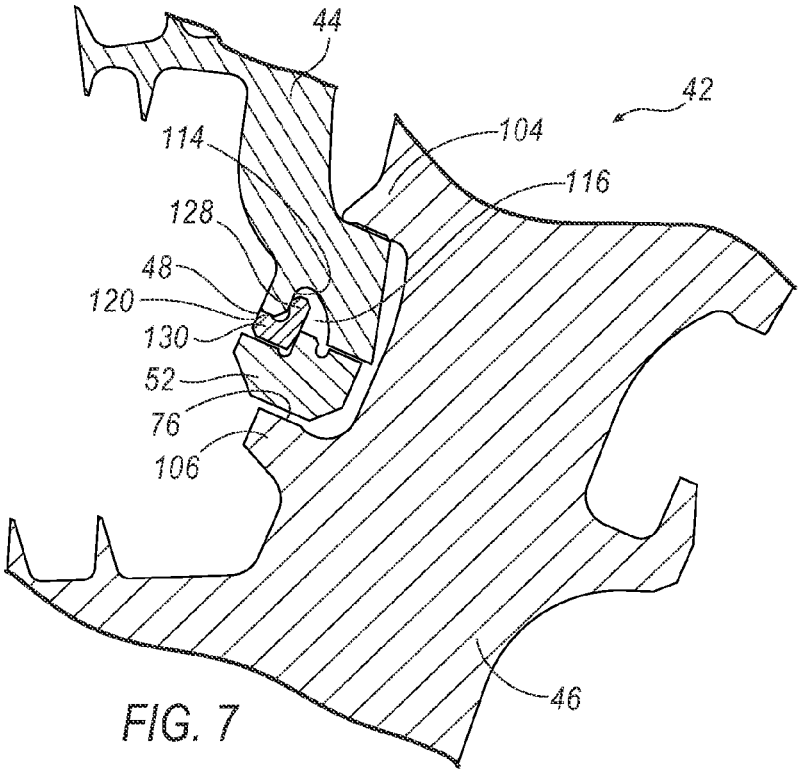
FIG. 7 illustrates an enlarged side-sectional view, taken from lines 7-7 of FIG. 5B, showing the radial retention peg installed with the cover plate and disk of the gas turbine assembly.

With reference to FIG. 7, this figure illustrates an enlarged sectional view taken from the perspective of lines 7-7 of FIG. 5B. The disk 46 is shown mounting the cover plate 44, retainer ring 48, and radial retention peg 52. This is accomplished by the outer and inner members 104 and 106 circumscribing and radially retaining the cover plate 44, the split retainer ring 48 and the radial retention peg 52. The split retaining ring 48 lies partially within the opening 116. The split retaining ring 48 is held axially in place by virtue of the upwardly extending portion 128 of the L-shaped split retainer ring 48 impinging upon an inner face 114 of the cover plate 44. The retaining ring 48 is captured radially in place in part by the based portion 130 of the retaining ring 48 and the radial retention surface 76 of the radial retention peg 52 and the first surface 120 of the cover plate 44. The split retainer 48 is preferably made of metal materials that are sufficient to withstand the environmental conditions of a gas turbine engine.

An exemplary method of installing a split ring 48 for a gas turbine assembly 42, will now be presented. It will be appreciated that other steps of assembly or disassembly, could be employed. First, the cover plate 44 is pressed onto the disk 46 such that the bayonet tabs 118 are positioned within the recess 102. Next, the cover plate 44 is rotated relative to the disk 46 to align and engage the bayonet features 111 and 118. Then an anti-rotation peg 50 is inserted into the space adjacent the bayonet tabs 111 and 118. A pre-determined number of radial retention pegs 52 can now be installed within slots 56 around the periphery of the disk 46. Such member could include enough to balance the turbine assembly 42. In the embodiment shown, five pegs 52 are employed. Finally, and preferably starting near the anti-rotation peg 50, the retainer ring 48 is fed under the anti-rotation peg as it is fed between cover plate 44 and radial pegs 52. The last step is to orient the ring 48 such that tab 60 is inserted into gap 58.

The installation method is accomplished without any added tools for installing the pegs or the ring 48. The ring 48 may be circumferentially located in the direction of arrow 78 (see FIG. 4) and the pegs 52 may be positioned at various slots 56, as is desired. This arrangement prevents the ring from rotating during engine operation. To disassemble the assembly 42, the inverse steps could be employed.

It will be appreciated that the aforementioned method and devices may be modified to have some components and steps removed, or may have additional components and steps added, all of which are deemed to be within the spirit of the present disclosure. Even though the present disclosure has been described in detail with reference to specific embodiments, it will be appreciated that the various modification and changes can be made to these embodiments without departing from the scope of the present disclosure as set forth in the claims. The specification and the drawings are to be regarded as an illustrative thought instead of merely restrictive thought.

What is claimed is:

1. A disk arrangement for a gas turbine engine comprising:
- a disk with a bayonet feature;
- a cover plate with a bayonet feature;
- a split retainer ring;
- an anti-rotation peg having a first surface for engaging the split retainer ring,
- a second surface for engaging the cover plate, and a third surface for engaging the disk; and
- a radial retention peg,
- wherein the anti-rotation peg includes at least one of:
  - a radially-oriented tab that projects from a surface and engages an opening in the retainer ring; or
  - a stop that engages the retainer ring and prevents the retainer ring from rotating relative to the disk and the cover plate.

2. The disk arrangement for a gas turbine engine as claimed in claim 1, wherein the disk includes an arcuate shaped opening, and the cover plate includes an arcuate shaped opening, the openings may be aligned to receive a peg.

3. The disk arrangement for a gas turbine engine as claimed in claim 1, wherein the split retainer ring is substantially L-shaped from a side sectional view perspective, and is substantially C-shaped from a front view perspective.

4. The disk arrangement for a gas turbine engine as claimed in claim 1, wherein the split retainer ring has a first surface for engaging the cover plate, and a second surface for engaging the radial retention peg, the split retainer ring radially retains the pegs in the opening between the bayonet features of the disk and cover plate.

5. The disk arrangement for a gas turbine engine as claimed in claim 1, wherein the split retainer ring retains the pegs in a slot that is created by the bayonet feature of at least one of the disk and cover plate.

6. The disk arrangement for a gas turbine engine as claimed in claim 1, wherein the anti-rotation peg includes a radial outer surface for engaging a radial inner surface of the cover plate.

7. The disk arrangement for a gas turbine engine as claimed in claim 1, wherein the radial retention peg includes an L-shaped surface that mates with a corresponding L-shaped surface of the split retainer ring.

8. The disk arrangement for a gas turbine engine as claimed in claim 1, further comprising a plurality of radial retention pegs, each said peg being inserted into an aperture that is created by the bayonet features of the disk and cover plate.

9. A system for a gas turbine engine comprising:

an annular shaped disk having a plurality of openings;

a cover plate having a member that extends within an opening in the disk;

an anti-rotation peg having a surface that engages the cover plate;

at least one radial retention peg having a surface that engages the cover plate; and a retainer member sandwiched between the cover plate and the radial retention peg, wherein the anti-rotation peg includes at least one of:

a radially-oriented tab that projects from a surface and engages an opening in a retainer ring; or a stop that engages the retainer ring and prevents the retainer ring from rotating relative to the disk and the cover plate.

10. The system as claimed in claim 9, wherein the anti-rotation peg has the radially-oriented tab that projects from the surface, wherein the tab engages the opening in the retainer ring.

11. The system as claimed in claim 9, wherein the anti-rotation peg has the stop that engages the retainer ring and prevents the retainer ring from rotating relative to the disk and the cover plate.

12. The system as claimed in claim 9, wherein the anti-rotation peg can be removed from the system, which allows the retainer ring to be rotated to a new position, and the anti-rotation peg can then be inserted into another opening in the disk to position the retainer ring into place.

13. The system as claimed in claim 9, wherein the cover plate has a cavity with an L-shaped wall that substantially mates with a corresponding L-shaped wall of the retainer member.

14. The system as claimed in claim 9, wherein the retainer ring is split.

15. The system as claimed in claim 9, wherein the retainer ring has a first surface for axially engaging the cover plate, the retainer ring has a second surface for radially engaging the cover plate.

16. The system as claimed in claim 9, further comprising a plurality of radial retention pegs, each such peg positioned in an opening in the disk.

17. The system as claimed in claim 9, wherein the system is a high or low pressure turbine.

18. A method of a gas turbine machine comprising steps of:

providing a disk, a cover plate, an anti-rotation peg, at least one radial retention peg, and a retainer ring;

positioning a portion of the cover plate into a cavity of the disk;

inserting the radial retention peg into a cavity of the disk;

inserting the anti-rotation peg into the cavity of the disk; and inserting the retainer ring, whereby the anti-rotation peg prevents the retainer ring from rotating wherein the anti-rotation peg includes at least one of:

a radially-oriented tab that projects from a surface and engages an opening in the retainer ring; or a stop that engages the retainer ring and prevents the retainer ring from rotating relative to the disk and the cover plate.

19. The method as claimed in claimed 18, wherein the retainer ring includes a split ring, and further comprising the step of correcting imbalance of the gas turbine machine, the correcting imbalance step includes removing the anti-rotation peg, advancing the split ring in a clockwise or counter-clockwise direction, and then reinserting the anti-rotation peg into an aperture.

20. The method as claimed in claimed 18, further comprising the step of determining a turbo machine unbalanced condition, and then adjusting the positioning of one or more radial retention pegs relative to the disk so as to create a balanced-like condition of the turbo machine.

* * * * *